US008068752B2

(12) United States Patent
Sugiyama

(10) Patent No.: US 8,068,752 B2
(45) Date of Patent: Nov. 29, 2011

(54) IMAGE FORMING APPARATUS AND METHOD FOR CONTROLLING IMAGE FORMING APPARATUS

(75) Inventor: Yuki Sugiyama, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 177 days.

(21) Appl. No.: 12/612,918

(22) Filed: Nov. 5, 2009

(65) Prior Publication Data

US 2010/0124427 A1 May 20, 2010

(30) Foreign Application Priority Data

Nov. 14, 2008 (JP) ..... 2008-292608
Oct. 28, 2009 (JP) ..... 2009-247620

(51) Int. Cl.
*G03G 15/06* (2006.01)

(52) U.S. Cl. ..... 399/53; 399/228

(58) Field of Classification Search ..... 399/43, 399/53, 228; 347/140
See application file for complete search history.

(56) References Cited

FOREIGN PATENT DOCUMENTS

JP 2006-285294 A 10/2006

*Primary Examiner* — Mark R Gaworecki
(74) *Attorney, Agent, or Firm* — Fitzpatrick, Cella, Harper & Scinto

(57) ABSTRACT

An image forming apparatus is provided that reduces the occurrence of downtime in the case in which the interval between sheets needs to be expanded, and also suppresses the degradation of a photosensitive drum and a developing roller, when continuously forming images. The image forming apparatus of the present invention predicts the start timing of image formation onto the next printing material, and performs control of the positional relationship between the photosensitive drum and the developing roller without decreasing productivity, based on a result of the prediction. Further, the image forming apparatus performs control of the rotating operation of the photosensitive drum, based on the above prediction result.

12 Claims, 15 Drawing Sheets

IMAGE FORMING APPARATUS AND METHOD FOR CONTROLLING IMAGE FORMING APPARATUS

BACKGROUND OF THE INVENTION

1. Field of the Invention

The present invention relates to an image forming apparatus such as an electrophotographic copying machine or a laser beam printer, and a method for controlling the image forming apparatus.

2. Description of the Related Art

Generally, an image forming apparatus forms an electrostatic latent image by exposing the surface of a photosensitive drum that has been uniformly charged by a charging unit, according to image data, and forms a toner image by a developing roller supplying toner and developing the electrostatic latent image formed on the photosensitive drum. Furthermore, image formation is performed by a transfer roller transferring the toner image formed on the photosensitive drum onto a printing material. Note that the developing process on the photosensitive drum is performed in a state in which the developing roller is in contact with the photosensitive drum. Further, in the case in which images are continuously formed on a plurality of printing materials, the image forming apparatus continuously performs the image forming process while maintaining a state in which the developing roller and the photosensitive drum are in contact, even during the period between one printing material being conveyed and the next printing material being conveyed (hereinafter, referred to as "the interval between sheets"), in order to maintain throughput.

In an image forming apparatus such as mentioned above, a rendering process on image data for forming an image on a printing material may require a longer time than normal. For example, a longer time may be required for a rendering process on image data in the case of a high-resolution color image or photographic image. In such cases, the image forming apparatus postpones the timing for starting image formation by expanding the interval between sheets. However, in the case in which the interval between sheets is expanded by extending the start timing of image formation, there is the problem of the degradation speed of the photosensitive drum being accelerated compared with normal continuous image formation, since the charging unit continues applying a charging voltage to the photosensitive drum during the time for the expanded interval between sheets.

As a technique for solving this problem, for example, Japanese Patent Laid-Open No. 2006-285294 proposes an image forming apparatus that temporarily stops charging the photosensitive drum if the interval between sheets is expanded more than normal, due, for instance, to an image rendering process performed by a controller unit taking a long time. In the image forming apparatus disclosed in Japanese Patent Laid-Open No. 2006-285294, the degradation speed of the photosensitive drum is thereby slowed.

However, the above-mentioned conventional technique has the following problem. For example, with the image forming apparatus disclosed in Japanese Patent Laid-Open No. 2006-285294, contact between a photosensitive drum and a developing roller is maintained during the interval between sheets, despite a charging voltage having been stopped. Therefore, there is the problem of the wear of the photosensitive drum and the developing roller being accelerated due to friction therebetween.

SUMMARY OF THE INVENTION

The present invention has been made in view of the above-mentioned problem, and provides an image forming apparatus that reduces the occurrence of downtime in the case in which the interval between sheets needs to be expanded, and also suppresses the degradation of a photosensitive drum and a developing roller, when continuously forming images on a plurality of printing materials, and a control method therefor.

One aspect of the present invention provides an image forming apparatus comprising: an image carrier for having an image formed thereon; a developing member that is capable of coming into contact with and separating from the image carrier, and that forms an image on the image carrier by coming into contact with the image carrier and is separated from the image carrier after image formation on the image carrier ends; and a determination unit that determines, in a case in which a start of image formation is delayed beyond a predetermined start timing of image formation on the image carrier, when continuously forming a plurality of images, whether to separate the developing member from the image carrier, based on a delay time until the start of image formation and a time necessary for the developing member to separate from and come into contact with the image carrier.

Another aspect of the present invention provides an image forming apparatus that is provided with a plurality of image forming units each including an image carrier for having an image formed thereon, and a developing member which is capable of coming into contact with and separating from the image carrier, and which forms an image on the image carrier by coming into contact with the image carrier and is separated from the image carrier after image formation on the image carrier ends, and that is capable of switching between a first mode in which a multicolor image is formed using all of the plurality of image forming units, and a second mode in which a single color image is formed using one of the plurality of image forming units, the image forming apparatus comprising: a control unit that performs control such that an image is formed in the first mode, in a case in which there are both the multicolor image and the single color image, when continuously forming a plurality of images; and a determination unit that determines, in a case in which a start of formation of the single color image is delayed beyond a predetermined start timing of image formation in a case of forming the single color image after formation of the multicolor image, whether to separate the developing member of the image forming unit other than the image forming unit to be used for forming the single color image, based on a delay time until the start of formation of the single color image and a time necessary for the developing member of the image forming unit other than the image forming unit to be used for forming the single color image to separate and come into contact.

Still another aspect of the present invention provides a method for controlling an image forming apparatus that is provided with an image carrier for having an image formed thereon, and a developing member which is capable of coming into contact with and separating from the image carrier, and which forms an image on the image carrier by coming into contact with the image carrier and is separated from the image carrier after image formation on the image carrier ends, the method comprising the steps of: comparing a delay time for a case in which a start of image formation is delayed relative to a predetermined start timing of image formation on the image carrier with a time necessary for causing the developing member to come into contact with and separate from the image carrier, when continuously forming a plurality of images; and determining whether to separate the developing member from the image carrier, based on a comparison result.

According to the present invention, an image forming apparatus that reduces the occurrence of downtime in the case in which the interval between sheets needs to be expanded, and also suppresses the degradation of a photosensitive drum and a developing roller, when continuously forming images on a plurality of printing materials, and a control method therefor can be provided.

Further features of the present invention will become apparent from the following description of exemplary embodiments with reference to the attached drawings.

DESCRIPTION OF THE EMBODIMENTS

First Embodiment

Overall Configuration of Image Forming Apparatus

Figure 1:
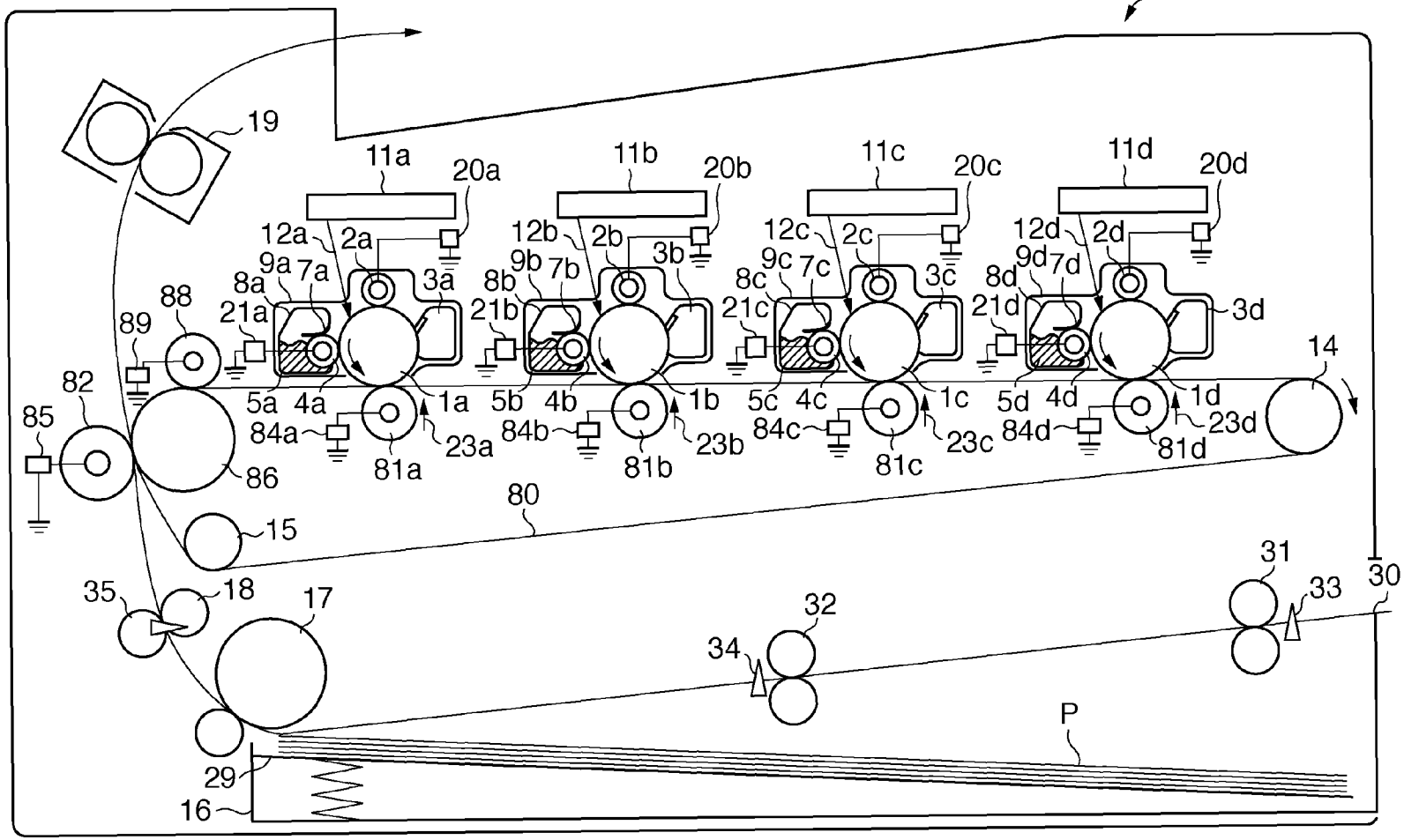
FIG. 1 is a diagram showing an example configuration of an image forming apparatus according to a first embodiment.

Below, a first embodiment of the present invention is described with reference to FIG. 1 to FIG. 7. FIG. 1 is a diagram showing an example configuration of an image forming apparatus according to the first embodiment. An image forming apparatus 10 broadly includes an image forming unit, a feeding unit, and a fixing unit.

Image Forming Unit

In the image forming unit, four image forming stations are disposed side by side for each color of toner serving as developing materials. The image forming stations are stations for forming images using toner serving as developing materials of the colors yellow, magenta, cyan, and black, in order from a first station. Since all the stations have the same configuration, only the first station is described below. However, constituent elements of a second station (corresponding to a numeral b), a third station (corresponding to a numeral c), and a fourth station (corresponding to a numeral d) can be represented by changing a numeral given at the end of reference numbers below to the numeral b, c, or d.

The image forming unit includes a photosensitive drum 1*a* that is an image carrier provided per station, a charging roller 2*a*, a developing unit 8*a*, an exposing unit 11*a*, a primary transfer roller 81*a*, a cleaning unit 3*a* that cleans post-transfer residual toner on the photosensitive drum 1*a*, and an intermediate transfer belt 80. The developing unit 8*a* functions as a developing member, and is provided with a developing roller 4*a* that is in contact with the photosensitive drum 1*a*, a toner storage portion 5*a*, and a blade 7*a* for applying a developing material. In FIG. 1, the constituent elements denoted by reference numerals 1*a* to 8*a* serve as an integrated process cartridge 9*a* that is removable from the image forming apparatus 10. In the image forming unit, an electrostatic latent image is formed by exposing the photosensitive drum 1*a* to light formed based on an image signal transmitted from a controller (not shown). Furthermore, a visible color image is formed by developing this electrostatic latent image using toner, and performing multiple transfer of visible images. After that, this visible color image is transferred onto a transfer material, and fixed on the transfer material.

In the present example, the photosensitive drum 1*a* is constituted by organic photoconductor layers (OPC) being applied to the outer circumferential face of an aluminum cylinder, with functional organic materials being laminated on the metal cylinder in a plurality of layers, including a carrier generation layer that is exposed and generates charge, a charge transportation layer that transports the generated charge, and the like. Note that the outermost layer has low electrical conductivity and is substantially insulated. Further, the photosensitive drum 1*a* is rotatably supported at both ends thereof by flanges, and rotationally driven counterclockwise in FIG. 1 by a driving force being transmitted from a drive motor (not shown) to one end thereof.

The charging roller 2*a* is a conductive roller formed in the shape of a roller; it uniformly charges the photosensitive drum surface while rotating following the rotation of the photosensitive drum 1*a* and being in a state of contact with the photosensitive drum 1*a*. A voltage on which a direct current voltage or an alternating current voltage has been superimposed is applied to the charging roller 2*a*. Accordingly, the photosensitive drum surface is uniformly charged by a discharge occurring from a contact nip portion of the charging roller 2*a* and the photosensitive drum surface in a small space on the upstream and downstream sides.

A scanner unit that scans with a laser beam using a multifaceted mirror (also referred to as a polygon mirror), or an LED array can be applied to the exposing unit 11*a*. This exposing unit 11*a* irradiates a scanning beam 12*a* modulated based on an image signal onto the photosensitive drum 1*a*.

Note that the charging roller 2*a*, the developing roller 4*a*, and the primary transfer roller 81*a* are connected to a charging bias power supply 20*a*, a developing bias power supply 21*a*, and a primary transfer bias power supply 84*a*, respectively.

The intermediate transfer belt 80 is supported by three rollers consisting of a secondary transfer facing roller 86, a driving roller 14, and a tension roller 15, as suspending members thereof, and an appropriate tension is maintained. As a result of the driving roller 14 being driven, the intermediate transfer belt 80 moves clockwise in FIG. 1 at the substantially same speed as the rotational speed of the photosensitive drum 1*a*. The primary transfer roller 81*a* is disposed facing the photosensitive drum 1*a* with the intermediate transfer belt 80 therebetween. A charge removing member 23*a* is disposed in the vicinity of the primary transfer roller 81*a*, and the driving roller 14, the tension roller 15, the charge removing member 23*a*, and the secondary transfer facing roller 86 are electrically grounded. Note that a mark (not shown) is formed in a prescribed position of the intermediate transfer belt 80, and a /TOP signal (described below) is output and image formation on the photosensitive drum 1*a* is started, based on a timing at which this mark is detected by a sensor (not shown). This mark may be provided to the intermediate transfer belt 80 in advance, or may be formed using a developing material (toner).

The developing unit 8*a* is provided with the toner storage portion 5*a* that stores a nonmagnetic one-component developing material, which is a developing material (toner) of the color yellow, magenta, cyan, or black, and the developing roller 4*a* that adjoins the surface of the photosensitive drum 1*a*. The developing roller 4*a* is rotationally driven by a driving unit (not shown), and performs developing by the developing bias power supply 21*a* applying a developing voltage.

The primary transfer roller 81*a* faces the photosensitive drums 1*a* out of the four photosensitive drums, and is in contact with the intermediate transfer belt 80 on the inner side of the intermediate transfer belt 80. The primary-transfer-bias power supply 84*a* is connected to the primary transfer roller 81*a*, and the negative polarity toner image on the photosensitive drum 1*a* that is in contact with the intermediate transfer belt 80 is transferred onto the intermediate transfer belt 80, due to the positive polarity charge of the primary transfer roller 81*a*. A multicolored image is formed on the intermediate transfer belt 80 by toner images of each color formed on the photosensitive drums 1*a* to 1*d* being sequentially transferred onto the intermediate transfer belt 80.

Feeding Unit

When feeding sheets from a body cassette 16, a bottom plate 29 of the body cassette rises as a result of a pickup roller 17 being driven, pushing up sheets P placed in the body cassette 16. Note that sheets are also referred to below as printing material, transfer material, and paper. The sheet at the top of the sheets P that have been pushed up comes into contact with the pickup roller 17, and the sheets are separated and fed one-by-one by the rotation of the pickup roller 17, and conveyed to a registration roller 18.

When feeding a sheet from a manual paper feed tray 30, a paper sensor 33 detects that a sheet P is set in the paper feed tray 30. If a sheet is set in the paper feed tray 30, draw rollers 31 feed the sheet until the leading edge of the sheet reaches a stop position 37. On receiving a print command when the leading edge of a sheet is positioned at the stop position 37, the sheet is conveyed by the draw rollers 31 and conveying rollers 32. The sheet is conveyed to directly under the pickup roller 17, by conveying the sheet for a prescribed time or through a prescribed step after a paper leading edge detection sensor 34 detects the leading edge of the sheet. At the point at which the leading edge of the sheet conveyed from the manual paper feed tray 30 is directly under the pickup roller 17, the pickup roller 17 is driven and the bottom plate 29 rises. Here, if sheets are placed in the body cassette 16, the sheets P placed in the body cassette 16 are pushed up. The sheet at the top of the sheets P that have been pushed up or the body cassette bottom plate pushes up the sheet conveyed from the manual paper feed tray 30. The sheet that has been pushed up comes into contact with the pickup roller 17, and is fed by the rotation of the pickup roller 17 and conveyed to the registration roller 18.

The sheet fed from the paper feed tray 30 to the registration roller 18 is conveyed to a secondary transfer unit by the registration roller 18.

The intermediate transfer belt 80 constituting the secondary transfer unit is supported so as to be suspended by three rollers consisting of the secondary transfer facing roller 86, the driving roller 14, and the tension roller 15, and set up facing all the photosensitive drums 1*a* to 1*d*. The intermediate transfer belt 80 is circulatingly moved by the driving roller 14, in order to electrostatically adhere toner to the outer circumferential face thereof facing the photosensitive drums 1*a* to 1*d*. A multi-colored image is thereby formed on the outer circumference of the intermediate transfer belt 80, and the image formed on the belt is conveyed to a portion where a secondary transfer roller 82 and the intermediate transfer belt 80 are in contact, which is a secondary transfer position.

When conveying a sheet, an electric field is formed around the secondary transfer facing roller 86 disposed facing the secondary transfer roller 82, by applying a voltage to the secondary transfer roller 82. Accordingly, dielectric polarization occurs between the intermediate transfer belt 80 and the sheet, and an electrostatic adhesion force is generated in both the belt and the sheet.

Fixing Unit

A fixing apparatus 19 applies heat and pressure to an image formed on a sheet, and fixes the toner image onto the sheet. Thus, the fixing apparatus 19 is provided with a fixing belt and elastic pressure rollers. The elastic pressure rollers sandwich the fixing belt, and form a fixing nip portion having a prescribed width with a belt-guide member (not shown) and a predetermined pressure force.

A sheet on which an unfixed toner image is formed is conveyed from the image forming unit to the fixing nip portion that is in a temperature controlled state after having risen to a predetermined temperature. The sheet is introduced between the fixing belt and the elastic pressure rollers of the fixing nip portion, with the image side facing up, that is, facing the fixing belt side. The image side is in close contact with the outer surface of the fixing belt, and the sheet is sandwiched and conveyed together with the fixing belt through the fixing nip portion.

During the process in which the sheet is sandwiched and conveyed together with the fixing belt through the fixing nip portion, the unfixed toner image on the sheet is heated and fixed by the fixing belt.

Control Configuration of Image Forming Apparatus

Figure 2:
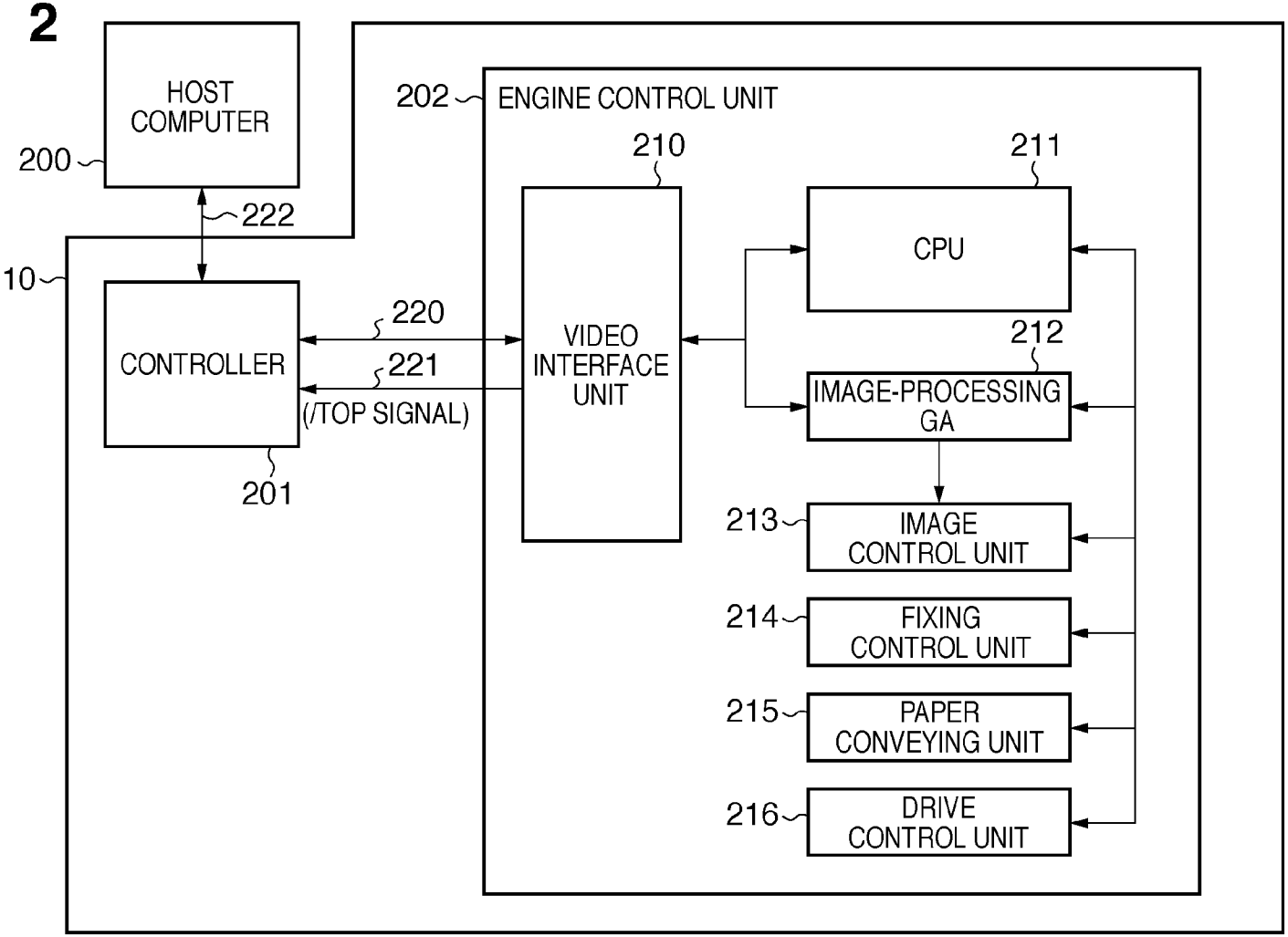
FIG. 2 is a diagram showing an example control configuration of the image forming apparatus according to the first embodiment.

Next, a control configuration of the image forming apparatus 10 is described with reference to FIG. 2. FIG. 2 is a block diagram showing an example control configuration of an image forming apparatus according to the first embodiment.

The image forming apparatus 10 is provided with a controller 201 and an engine control unit 202 as a control configuration. The controller 201 is intercommunicably connected to a host computer 200 and the engine control unit 202, and is provided with interfaces to the host computer 200 and the engine control unit 202, a processor, and a memory. On the other hand, the engine control unit 202 is provided with a video interface unit 210, a CPU 211, an image processing GA 212, an image control unit 213, a fixing control unit 214, a paper conveying unit 215, and a drive control unit 216.

The controller 201 receives image information and a print command from the host computer 200, analyzes the received image information, and converts the information into bit data. Further, the controller 201 transmits a print reservation command to the engine control unit 202 via the video interface unit 210, in accordance with a print command for each transfer material. Furthermore, the controller 201 transmits a print start command and a video signal to the engine control unit 202 at a timing at which a print-ready state is reached.

The engine control unit 202 prepares for print execution in the order of print reservation commands from the controller 201, and waits for a print start command from the controller. On receiving a print instruction, the engine control unit 202 outputs, to the controller 201, a /TOP signal used as the reference timing of video signal output, and starts a printing operation according to a print reservation command. The /TOP signal is equivalent to a vertical synchronizing signal between the controller 201 and the engine control unit 202, and is used as a trigger for transmitting image data for each page from the controller 201 to the engine control unit 202.

Comparative Example

Figure 3:
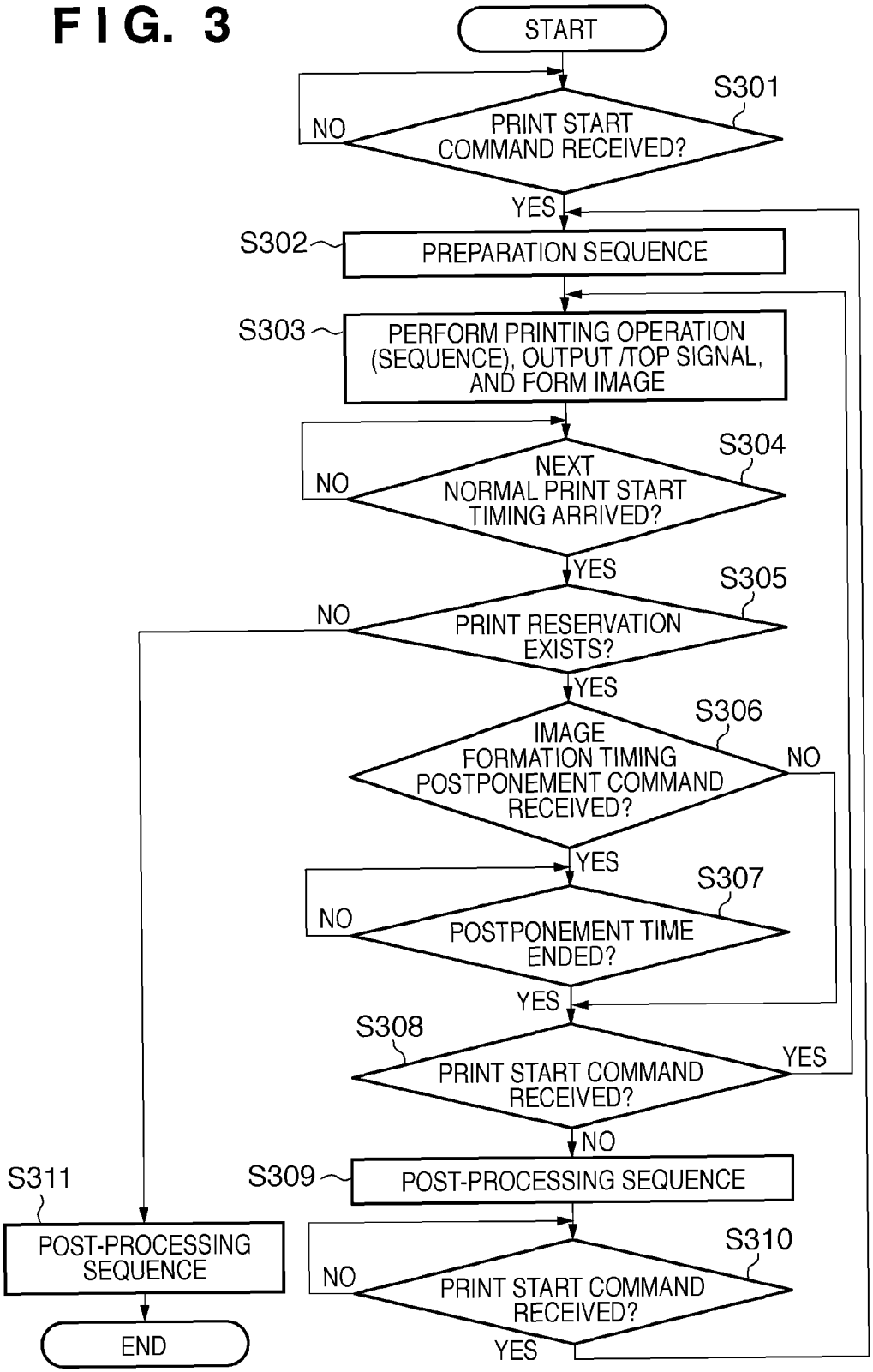
FIG. 3 is a diagram showing control that is a comparative example of the first embodiment.

Next, control that is a comparative example of the present invention is described with reference to FIG. 3. FIG. 3 is a flow chart showing the processing procedure of a printing operation performed by an engine control unit in the comparative example. In the comparative example, in the case of expanding the interval between sheets more than normal, a controller transmits a command for postponing post-processing of a printing operation (hereinafter, referred to as a "postponement command" for postponing the start timing of image formation) to an engine control unit. Accordingly, even in a case of expanding the interval between sheets according to an image rendering process performed by the controller, the effect of reducing the occurrence of downtime is obtained.

First, prior to printing (image formation), the controller transmits, to the engine control unit, a reservation command (print reservation command, etc.) for reserving a necessary operation in advance. The reservation command includes information regarding an operation to be executed in correspondence with the sequence of print instructions that will be subsequently issued. For example, the reservation command includes print operation conditions such as information regarding the paper feed cassette to be used, the printing material size, and the operation mode. Furthermore, the controller issues a print start command to the engine control unit so as to cause the engine control unit to perform printing based on reserved content.

In step S301, the engine control unit stands by until receiving a print start command issued by the controller.

On receiving a print start command, the engine control unit, in step S302, executes pre-processing that serves as a preparatory operation for performing a printing operation (hereinafter, referred to as a "preparation sequence"), based on the print start command. The preparation sequence includes control for causing a developing roller to come into contact with a photosensitive drum. Note that, regarding the operation for causing a photosensitive drum and a developing roller to come into contact and separate, the engine control unit is configured so as to be capable of individually causing the photosensitive drum and developing roller of each of the image forming stations to come into contact and separate.

In step S303, the engine control unit transmits a /TOP signal to the controller after a preparation sequence has ended, and starts a printing operation according to the print reservation command for the first sheet.

If, in step S305, the next print reservation command is not received by the next printing operation start timing (hereinafter, referred to as a "normal print start timing") for maintaining throughput, the engine control unit proceeds to step S311 and executes post-processing of a printing operation (hereinafter, referred to as a "post-processing sequence"), before ending the printing operation. On the other hand, if the command is received, the processing proceeds to step S306. The post-processing sequence includes control for causing the developing roller to separate from the photosensitive drum.

If, in step S306, a postponement command is received, the engine control unit proceeds to step S307. On the other hand, if a postponement command is not received, the engine control unit proceeds to step S308. Here, the postponement command is a command for notifying that the start of printing on the sheet after the sheet on which printing is currently being performed is postponed. This postponement command is transmitted from the controller to the engine control unit. Note that information regarding the amount of time by which the interval between sheets should be expanded (hereinafter, referred to as a "postponement time") is added to the postponement command.

In step S307, the engine control unit extends the interval between sheets by standing by until the designated postponement time ends. The developing roller is maintained in a state of contact during the extended period.

If, in step S308, a print start command for a print reservation command is received by the normal print start timing, in a case in which an image formation timing postponement command has not been received, the engine control unit proceeds to step S303. If, in a case in which a postponement command has been received, a print start command for a print reservation command is received by the time that the postponement time designated in the postponement command elapses, the engine control unit proceeds to step S303. In step S303, the engine control unit starts a printing operation for the second sheet following the first sheet.

On the other hand, if, in step S308, the engine control unit has not received a print start command, the processing proceeds to step S309.

In step S309, the engine control unit executes a post-processing sequence.

In step S310, the engine control unit enters a wait state of waiting for a print start command, and waits until receiving a print start command, before proceeding to step S302 and starting a preparation sequence.

As described above, in the comparative example, if the interval between sheets is extended due to a postponement command, the developing roller maintains a state of contact with the photosensitive drum during the time for the interval between sheets. Therefore, the degradation speed of the photosensitive drum and developing roller will be accelerated due to friction therebetween for the amount of time for which the interval between sheets is extended, compared with the normal continuous printing. On the other hand, the present embodiment described below is characterized in that wear of the photosensitive drum and developing roller during the time for the interval between sheets is reduced.

Communication Sequence when Printing

Figure 4:
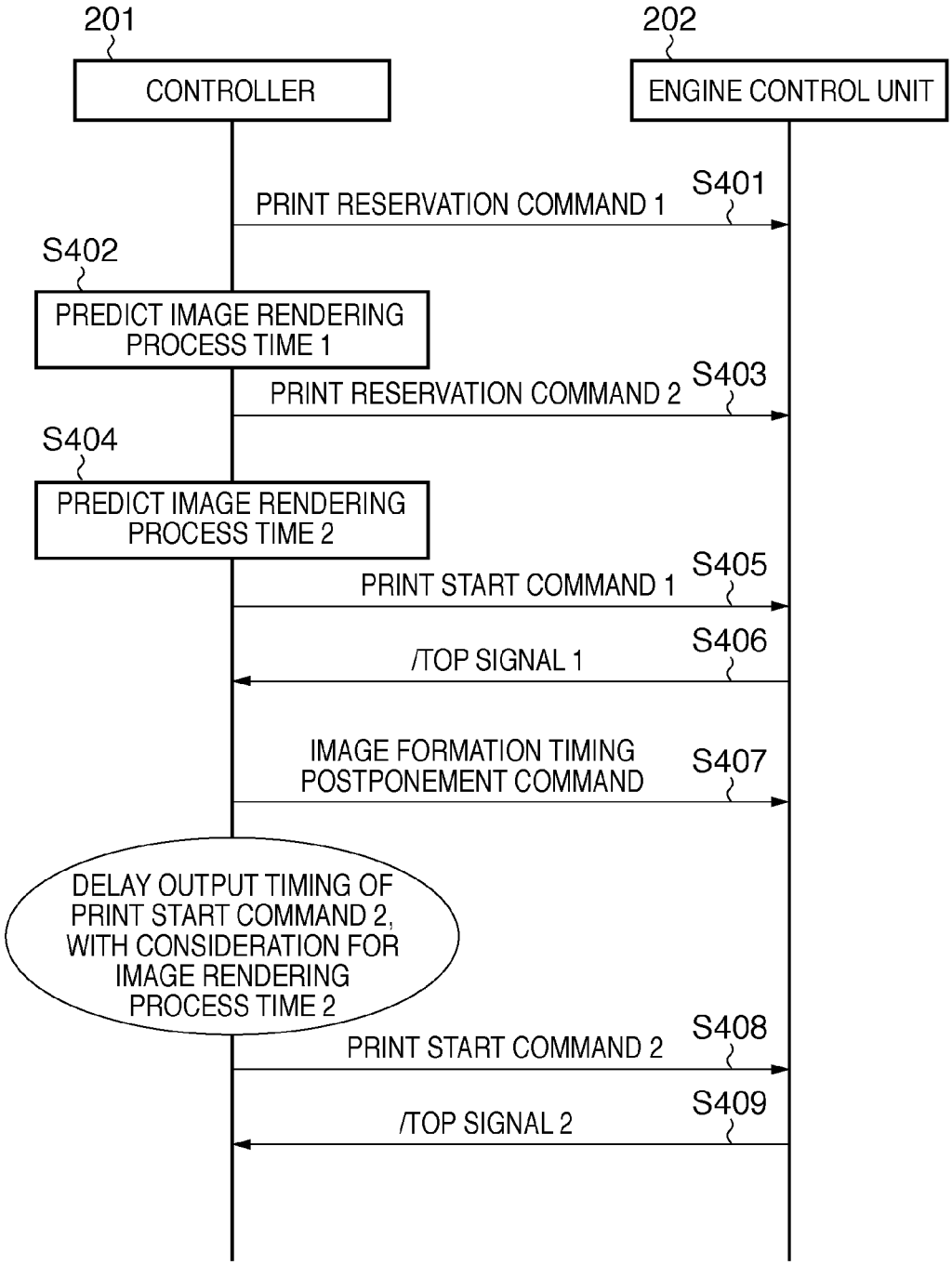
FIG. 4 is a sequence diagram showing an example of a communication sequence between a controller and an engine control unit according to the first embodiment.

Below, control of a printing operation according to an embodiment of the present invention is described with reference to FIG. 4, FIGS. 5A and 5B. FIG. 4 is a sequence diagram showing an example of a communication sequence between the controller 201 and the engine control unit 202 according to the first embodiment. FIG. 4 shows a case in which printing is continuously performed on two sheets of printing material.

In step S401, the controller 201 transmits, to the engine control unit 202, a print reservation command 1 that is based on image data for the first printing material.

In step S402, the controller 201 predicts the amount of time for performing an image rendering process on the image data for the first sheet.

Further, in step S403 and step S404, the controller 201 also executes a process for predicting the amount of time for performing an image rendering process on image data for the second printing material following the image data for the first sheet currently undergoing image formation.

As described with reference to FIG. 2, the controller 201 includes a processor, and may cause such a prediction process to be performed by causing the processor to execute a program including a predetermined procedure. For example, in a case in which a rendering process requires an extremely long time because of a great number of objects being included in the image to be printed, when printing after performing a banding process, rendering may be performed on a page-by-page basis in order to prevent data under-run. In such a case, the interval between pages (interval between sheets) may be excessively long, since a print instruction is only issued after one page of image data has been generated. In view of this, first, the controller 201 predicts the amount of time necessary for one page of rendering, based on the type and number of objects, for instance. Next, the controller 201 determines the amount of time from when printing of the previous page ends until the predicted start time of a rendering process (also referred to as rasterizing) on the page of interest, as the postponement time. In this way, the postponement time can be predicted based on the cause that generates the delay.

In step S405, the controller 201 transmits a print start command 1 to the engine control unit 202. Here, the engine control unit 202 starts a printing operation for the first sheet, and, in step S406, outputs a /TOP signal 1 to the controller 201.

In step S407, if an image rendering process time 2 for the second sheet predicted in step S404 is longer than the amount of time from transmission of the print reservation command 2 until the normal print start timing, the controller 201 transmits a postponement command to which the postponement time has been added, by the normal print start timing. That is, the controller 201 determines whether or not the predicted time predicted in step S402 exceeds a predetermined timing (normal print start timing), and transmits a postponement command based on the determination result. Here, this predetermined timing is set according to the timing at which an image formed on a photosensitive drum will be transferred onto the intermediate transfer belt, for example.

Next, in step S408, the controller 201 transmits a print start command for the second sheet, by the postponed start timing of image formation. In response to this, in step S409, the engine control unit 202 outputs a /TOP signal, and starts an image formation operation for the second sheet.

Control Procedure Performed by Engine Control Unit

Figure 5A:
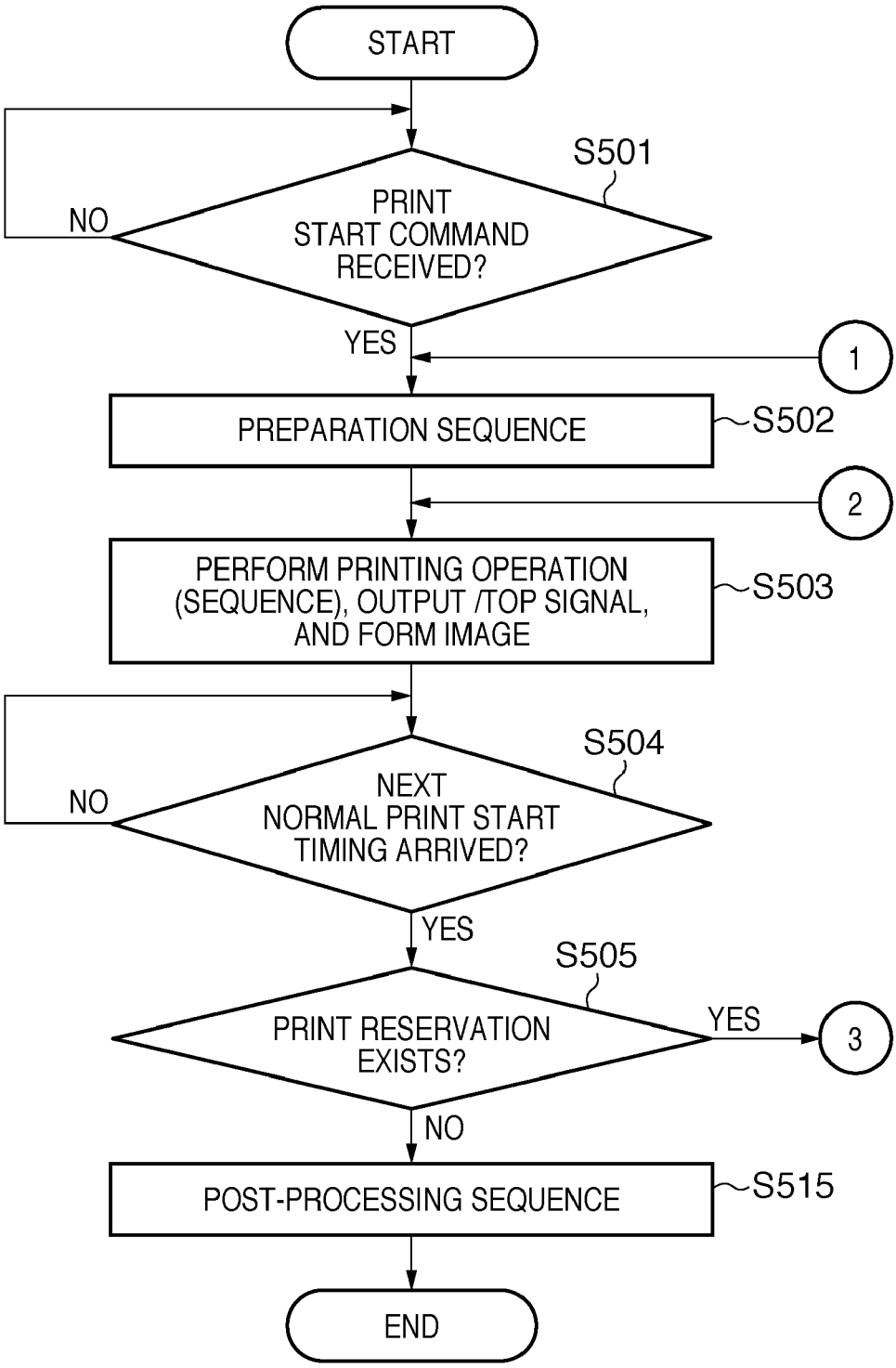
FIGS. 5A and 5B are a flow chart showing a processing procedure performed by the engine control unit in a printing operation according to the first embodiment.
Figure 5B:
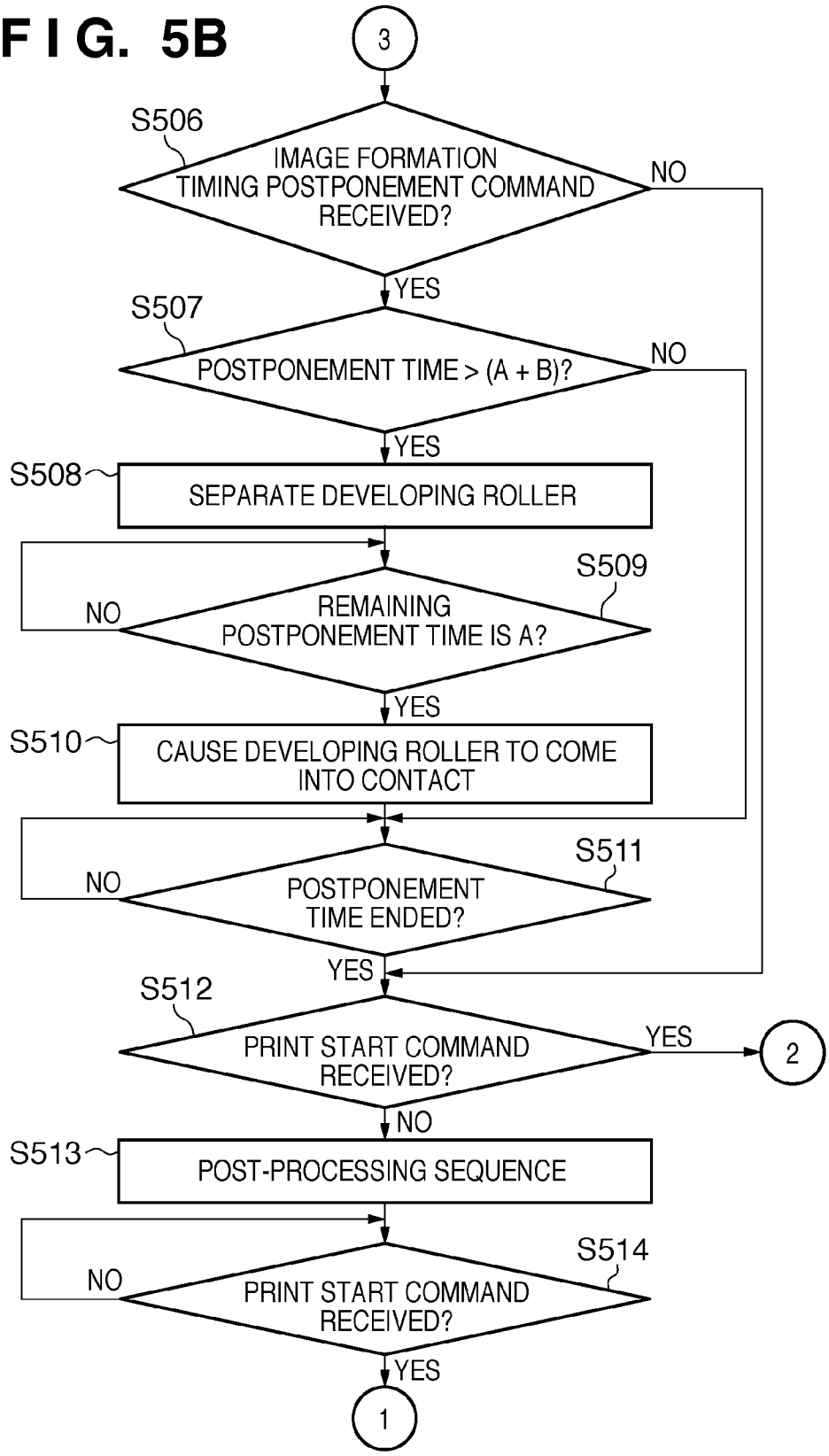
Figure 6:
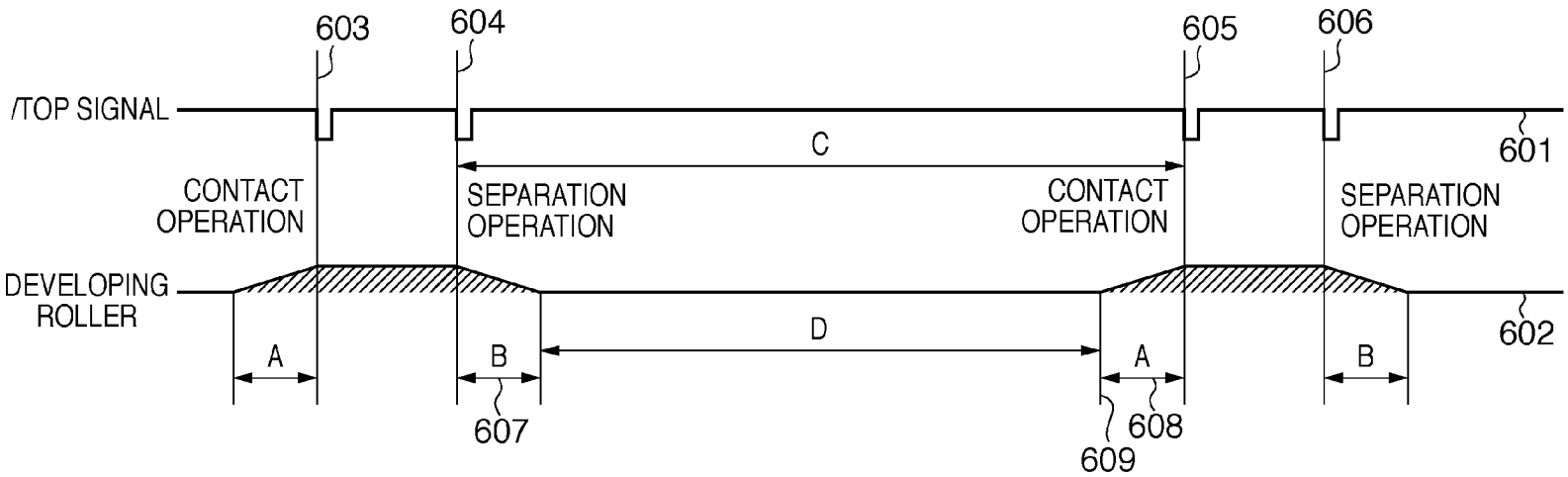
FIG. 6 is a timing chart showing the timing of a printing operation performed by the engine control unit according to the first embodiment.
Figure 7:
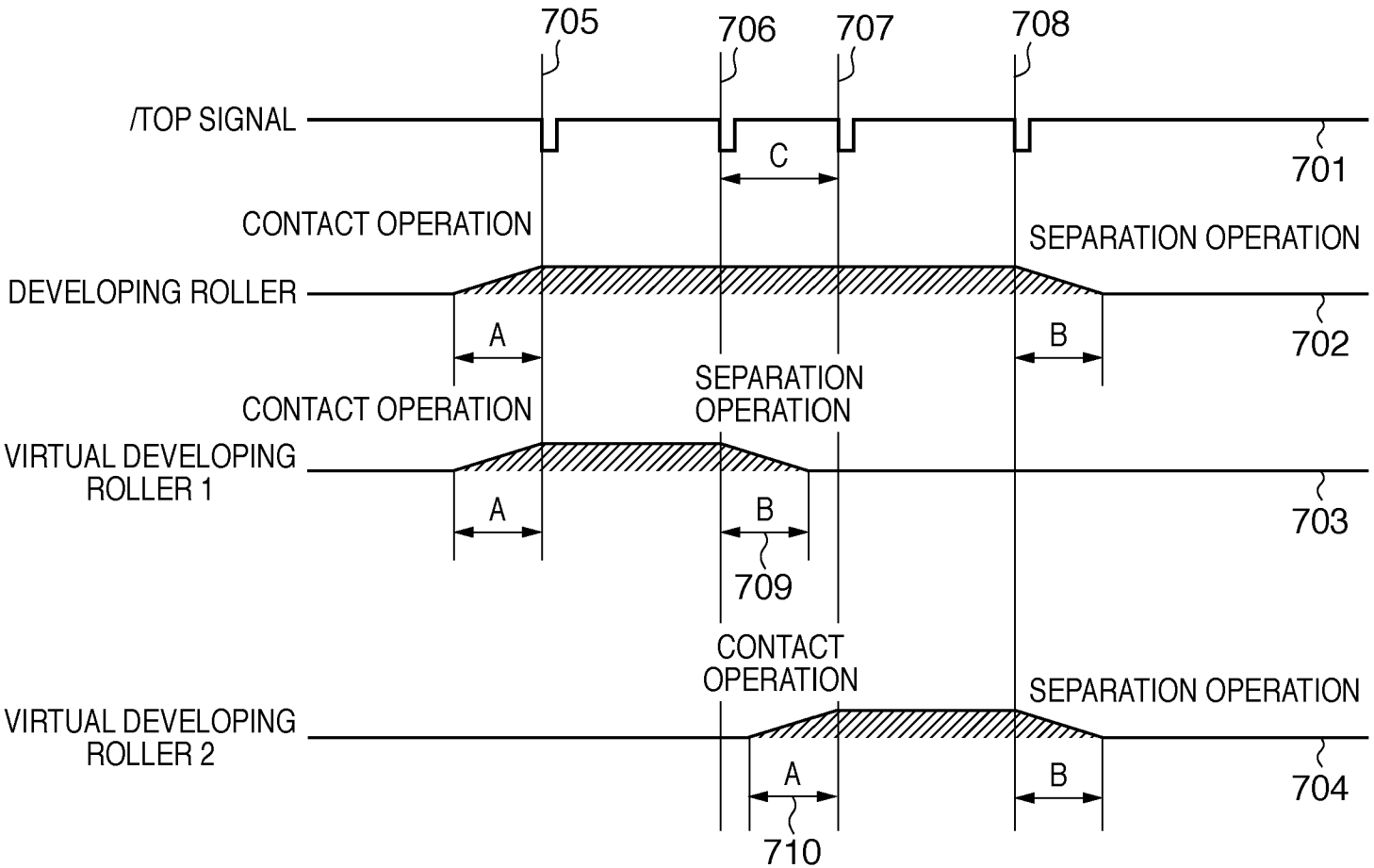
FIG. 7 is a timing chart showing the timing of a printing operation performed by the engine control unit according to the first embodiment.

FIGS. 5A and 5B are a flow chart showing a processing procedure performed by the engine control unit 202 in a printing operation according to the first embodiment. Further, FIG. 6 and FIG. 7 are timing charts showing the timing of a printing operation performed by the engine control unit 202 according to the first embodiment.

First, the controller 201 transmits a print reservation command to the engine control unit 202. In response to this, in step S501, the engine control unit 202 stands by until receiving a print start command subsequently issued from the controller 201.

In step S502, the engine control unit 202 executes a preparation sequence based on the print start command received in step S501.

In step S503, the engine control unit 202 outputs a /TOP signal after the preparation sequence has ended, and starts a printing operation according to the conditions designated in the print reservation command for the first sheet. Here, the print reservation command includes printing operation conditions such as information regarding the paper feed cassette to be used and the print mode.

If, in step S505, the next print reservation command is not received by the normal print start timing, the engine control unit 202 proceeds to step S515, and executes a post-processing sequence, before ending the printing operation.

If, in step S506, a postponement command has been received, the engine control unit 202 proceeds to step S507. On the other hand, if a postponement command has not been received, the engine control unit 202 proceeds to step S512. Note that a postponement time C has been added to the postponement command in order to expand the interval between sheets. Here, the postponement time C indicates a time difference from the normal print start timing (predetermined timing) until the start timing of the next printing operation.

In step S507, the engine control unit 202 executes one of the following processes, based on the postponement time C designated in the image formation timing postponement command from the controller 201. Note that the following processes are performed by a determination unit of the engine control unit 202. Here, in FIG. 6, reference numeral 601 denotes the output timing of /TOP signals, and reference numeral 602 denotes the operation timing of a developing roller. Signals 603, 604, 605, and 606 on reference numeral 601 are /TOP signals. Printing (forming) of an image for the first sheet is started by the signal 603, and next, the signal 604 indicates the normal print start timing for printing (forming) an image for the second sheet. In FIG. 6, a postponement time C is designated, and the timing for printing the image for the second sheet is delayed until the signal 605. Note that although the signal 606 indicates the normal print start timing for printing an image for the third sheet, the printing operation ends at the printing of images for two sheets in the case of FIG. 6. In FIG. 7, reference numeral 701 denotes the output timing of /TOP signals, reference numeral 702 denotes the operation timing of a developing roller, and reference numerals 703 and 704 denote the virtual operation timing of developing rollers. Signals 705, 706, 707, and 708 on reference numeral 701 are /TOP signals. Compared with FIG. 6, the postponement time C (interval between signals 706 and 707) is short, and the operation for not separating a developing roller (maintaining contact) is shown.

In step S507, as shown in FIG. 6, the engine control unit 202 compares the designated postponement time C with a total time (A+B) obtained by adding an amount of time B necessary for separating the developing roller (607) and an amount of time A necessary for causing the developing roller to come into contact (608). Based on the comparison result, the engine control unit 202 proceeds to step S508 if the postponement time C is longer than the total time (A+B).

In step S508, the engine control unit 202 causes the developing roller to separate at the normal print start timing for the second sheet (604). Specifically, the engine control unit 202 performs control of the photosensitive drum and developing roller that are currently in a state of contact to enter a state of separation, at the timing at which the printing operation that is currently being executed ends.

Furthermore, in steps S509 and S510, as shown in FIG. 6, the engine control unit 202 starts causing the developing roller to come into contact at the timing at which the remaining postponement time is the amount of time A (609), such that the developing roller is completely in contact at the print start timing for the second sheet (605) after the designated postponement time C has elapsed.

On the other hand, in step S507, as shown in FIG. 7, if the designated postponement time C is shorter than the amount of time (A+B) obtained by adding the amount of time B necessary for separating the developing roller (709) and the amount of time A necessary for causing the developing roller to come into contact (710), the engine control unit 202 maintains a state of contact with the developing roller during the postponement time C.

In step S511, the engine control unit 202 executes one of the above-mentioned processes, until the postponement time C elapses. In the following steps S512 to S514, the engine control unit 202 proceeds to similar processing to that in steps S308 to S310 of the comparative example shown in FIG. 3.

If, in step S512, a print start command for the print reservation command is received by the normal print start timing, in a case in which a postponement command for the image formation timing has not been received, the engine control unit 202 proceeds to step S503. If, in a case in which an image formation timing postponement command has been received, a print start command for a print reservation command is received by the time that the designated postponement time elapses, the engine control unit 202 proceeds to step S503. In step S503, the engine control unit 202 starts a printing operation for the second sheet following the first sheet.

On the other hand, if a print start command is not received in step S512, the engine control unit 202 proceeds to step S513.

In step S513, the engine control unit 202 executes a post-processing sequence.

In step S514, the engine control unit 202 enters a waiting state of waiting for a print start command, and waits until receiving a print start command, before proceeding to step S502 and starting a preparation sequence.

As described above, because the image forming apparatus according to the present embodiment does not proceed to a post-processing sequence due to a postponement command, if the interval between sheets is expanded more than normal according to an image rendering process, the image forming apparatus can reduce downtime. Furthermore, the developing roller is freely movable so as to be able to come into contact with and separate from the photosensitive drum, and if the postponement time is longer than the amount of time necessary for causing the developing roller to separate from and come into contact with the photosensitive drum, the photosensitive drum and the developing roller are temporarily separated. Accordingly, it is possible to reduce the degradation of the photosensitive drum and the developing roller.

Note that the above-described embodiment can be modified in various ways based on the spirit of the present invention, and is not intended to exclude these modifications from the scope of the invention. For example, the members to be separated due to the expanded time between sheets are not limited to the photosensitive drum and the developing roller, and may be members that wear out in a standby state in which printing can be immediately performed. In the case of such members, the life thereof can be prolonged by applying the present invention.

According to the present embodiment, an instruction is given from the controller to the engine control unit such that printing can be immediately started in the image forming apparatus according to processing performed by the controller. In response to the instruction, the engine control unit determines an operating state of the components that wear-out, such as whether the photosensitive drum and the developing roller are either in a state of contact or separation, for example.

Second Embodiment

Next, a second embodiment is described with reference to FIG. 8A to FIG. 10. The present embodiment is characterized in that when the developing roller is separated due to an image formation timing postponement command in the first embodiment, an amount of time for which the developing roller will be placed in a state of separation is further calculated, and rotation of the photosensitive drum is controlled based on this time. Note that since the overall configuration and control configuration of the image forming apparatus are similar to the configurations described with reference to FIG. 1 and FIG. 2, description thereof is omitted. Also, since the communication sequence when printing is similar to that shown in FIG. 4, description thereof is omitted.

Control Procedure Performed by Engine Control Unit

Figure 8A:
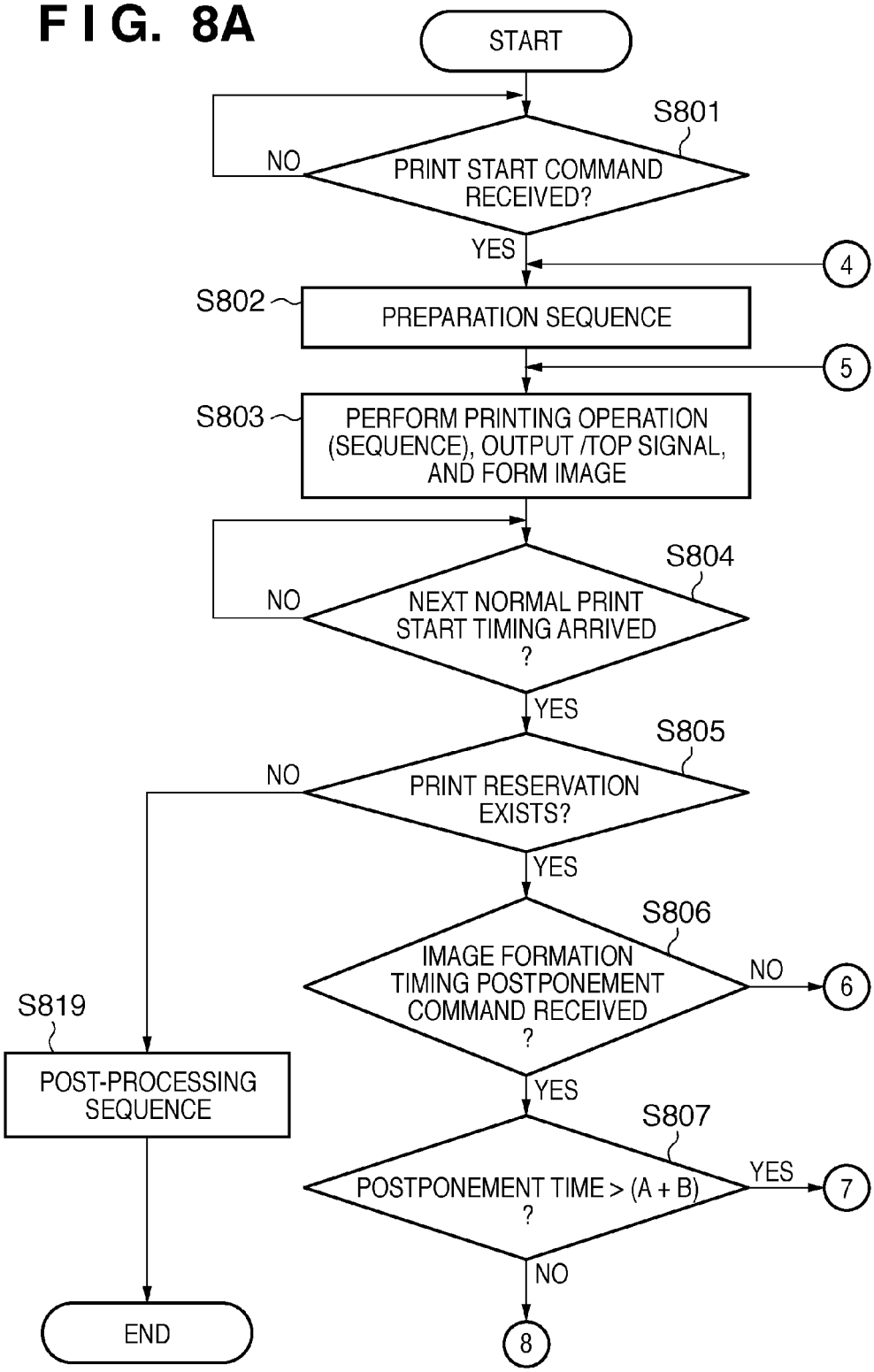
FIGS. 8A and 8B are a flow chart showing a processing procedure performed by an engine control unit in a printing operation according to a second embodiment.
Figure 8B:
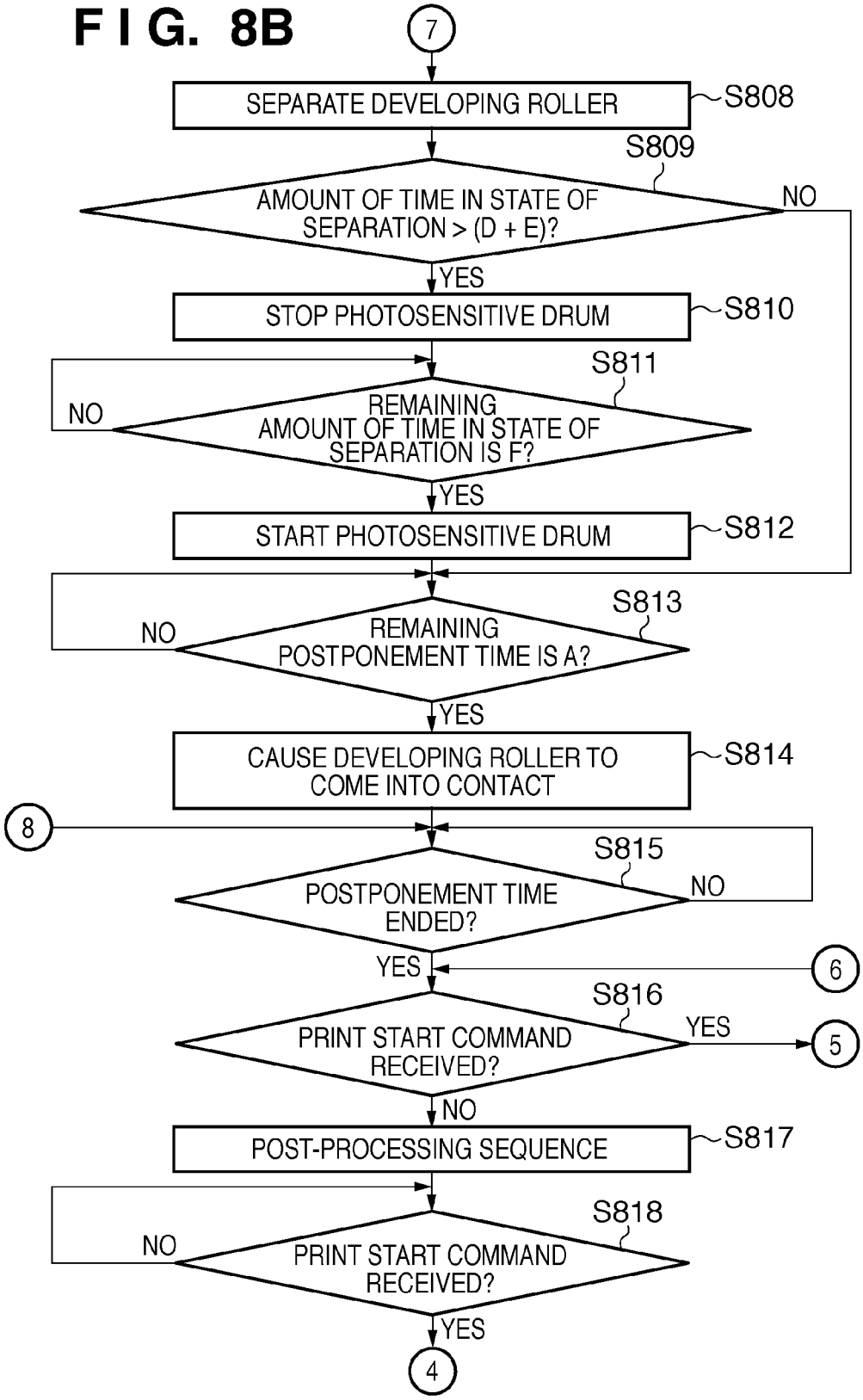
Figure 9:
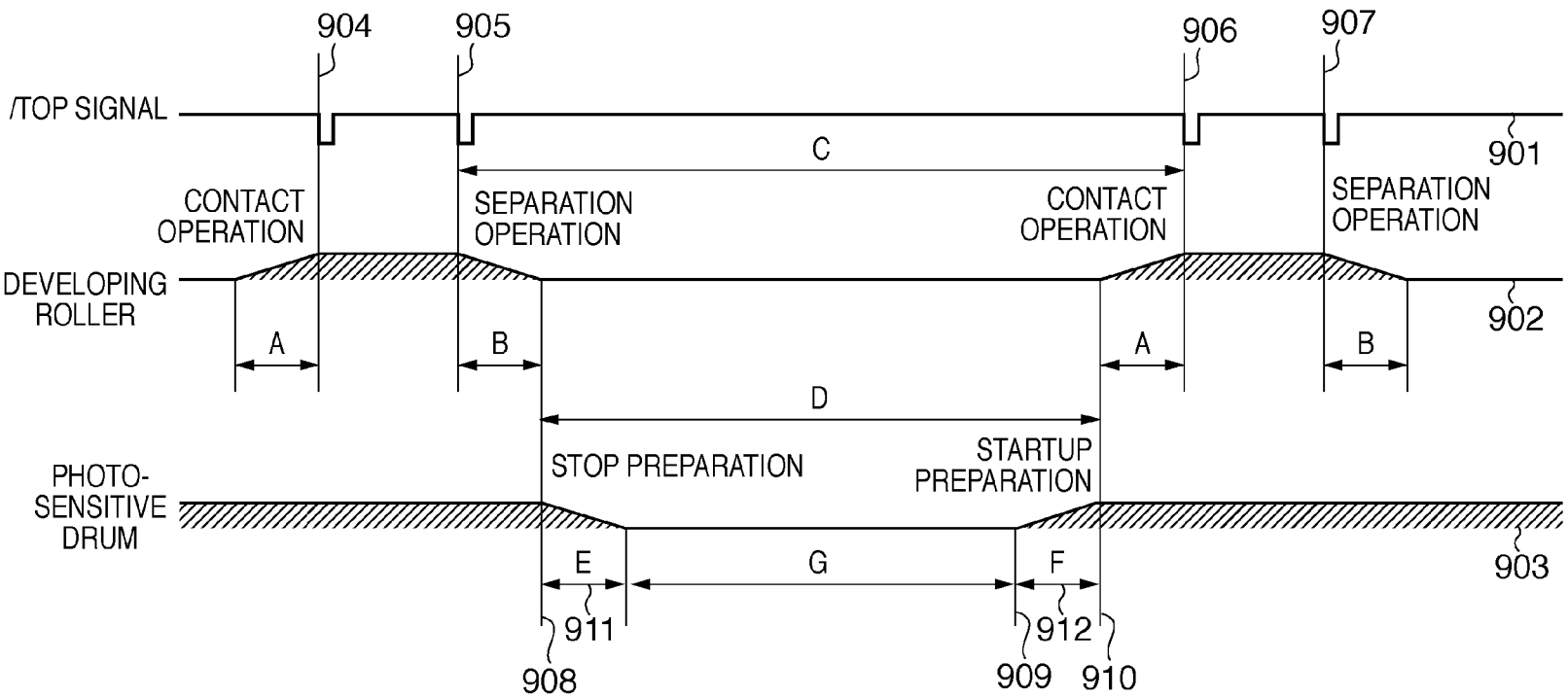
FIG. 9 is a timing chart showing the timing of a print operation performed by the engine control unit according to the second embodiment.
Figure 10:
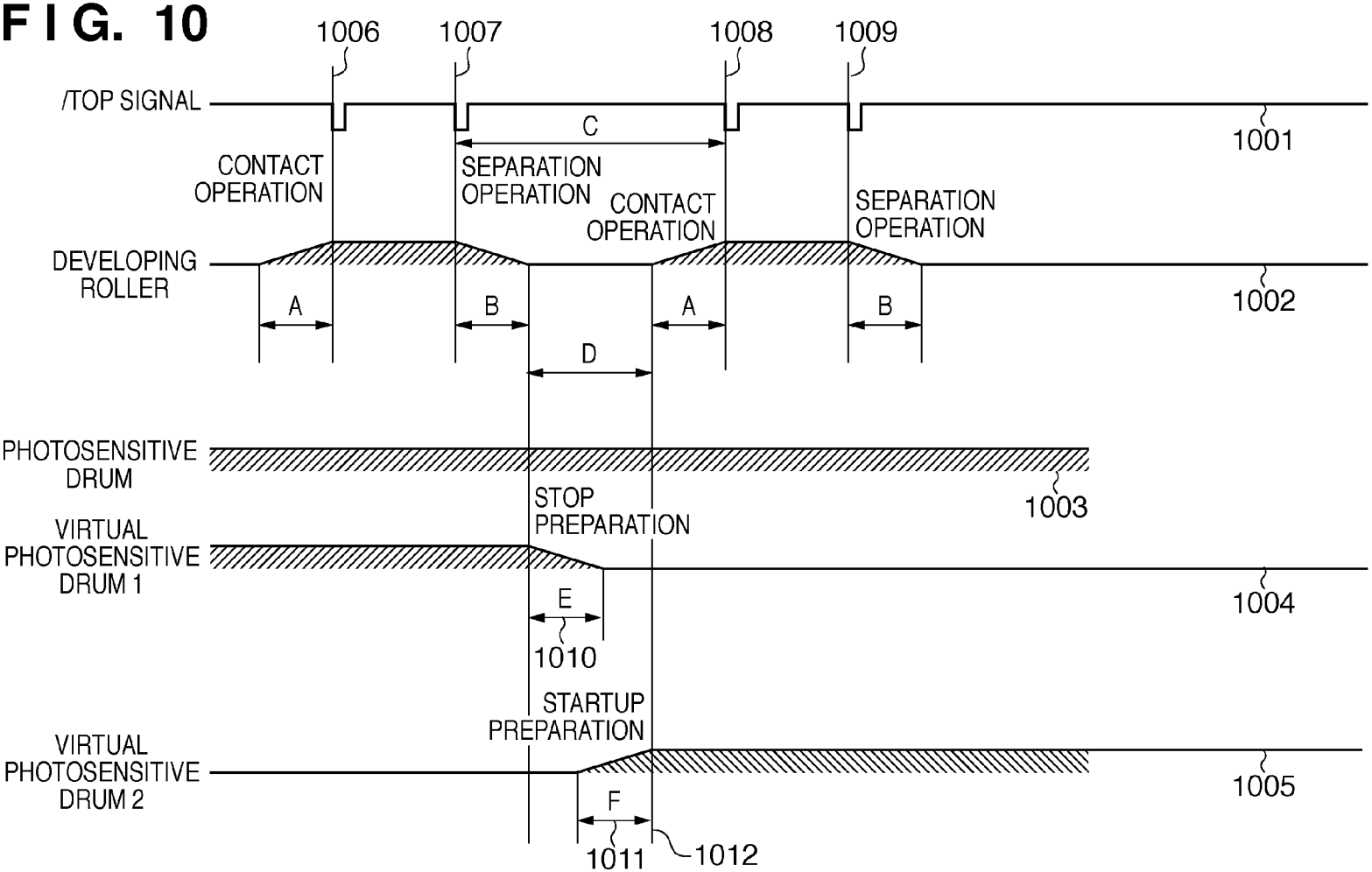
FIG. 10 is a timing chart showing the timing of a print operation performed by the engine control unit according to the second embodiment.

FIGS. 8A and 8B are a flow chart showing a processing procedure performed by the engine control unit 202 in a printing operation according to the second embodiment. FIG. 9 and FIG. 10 are timing charts showing the timing of a print operation performed by the engine control unit 202 according to the second embodiment. Since steps S801 to S808 in FIGS. 8A and 8B are similar to steps S501 to S508 in FIGS. 5A and 5B in the first embodiment, description thereof is omitted, and only aspects according to the present embodiment are described. Note that in FIG. 9, reference numeral 901 denotes the output timing of /TOP signals, and reference numeral 902 denotes the operation timing of the developing roller. Signals 904, 905, 906, and 907 on reference numeral 901 are /TOP signals. Printing (forming) of an image for the first sheet is started by the signal 904, and next, the signal 905 indicates the normal print start timing for printing (forming) an image for the second sheet. In FIG. 9, a postponement time C is designated, and the timing for printing the image for the second sheet is delayed until the signal 906. Note that although the signal 907 indicates the normal print start timing for printing an image for the third sheet, the printing operation ends at the printing of images for two sheets in the case of FIG. 9.

Further, in FIG. 10, reference numeral 1001 denotes the output timing of /TOP signals, reference numeral 1002 denotes the operation timing of a developing roller, reference numeral 1003 denotes the operation timing of a photosensitive drum, and reference numerals 1004 and 1005 denote the virtual operation timing of photosensitive drums. Signals 1006, 1007, 1008, and 1009 on reference numeral 1001 are /TOP signals. Compared with FIG. 9, the postponement time C (interval between signals 1007 and 1008) is short, and the operation for not separating a developing roller (maintaining contact) is shown.

In step S807, as shown in FIG. 6, similar to step S507 in the first embodiment, if the postponement time C designated in an image formation timing postponement command is longer than a total time (A+B) of an amount of time B for separating the developing roller (607) and an amount of time A for causing the developing roller to come into contact (608), the engine control unit 202 proceeds to step S808.

In step S808, the engine control unit 202 causes the developing roller to separate at the normal print start timing for the second sheet (604).

In step S809, first, the engine control unit 202 calculates an amount of time in a state of separation D shown in FIG. 9, based on the postponement time C, the amount of time B necessary for the control for separating a developing roller, and the amount of time A necessary for the control for causing a developing roller to come into contact. That is, D=(A+B)−C is calculated. Here, the amount of time in a state of separation D indicates the amount of time for which the developing roller is in a separated state from when separation of the developing roller from the photosensitive drum is completed until when the control is started to return to a state of contact again.

Furthermore, in step S809, the engine control unit 202 determines whether or not the amount of time in a state of separation D is longer than an amount of time obtained by adding an amount of time E necessary for stopping rotation of a photosensitive drum (911) and an amount of time F necessary for startup preparation of a photosensitive drum (912). If the determination result indicates that the amount of time in a state of separation D is longer, the processing proceeds to step S810. This determination processing is processed by the determination unit of the engine control unit 202. Note that the amount of time E necessary for stopping rotation of a photosensitive drum is the amount of time necessary for a driving unit (not shown) such as a motor that drives a photosensitive drum to stop and the photosensitive drum to reach a stopped state after the engine control unit 202 has instructed the motor to stop. The amount of time F necessary for startup preparation is the amount of time necessary for a photosensitive drum to reach a prescribed rotation speed after the engine control unit 202 has instructed the motor to start driving a photosensitive drum that is in a stopped state. These times E and F are predetermined based on the rotational speed of the photosensitive drum or the capacity of the motor serving as a driving unit.

In step S810, as shown in FIG. 9, the engine control unit 202 stops the photosensitive drum at the timing at which separation of the developing roller has ended (908). Here, an amount of time G for stopping the photosensitive drum is obtained by G=D−(E+F).

Furthermore, in steps S811 and S812, the engine control unit 202 starts the rotation of the photosensitive drum at the timing at which the amount of time F remains (909), such that the photosensitive drum reaches a constant-speed rotating state by the time the developing roller is next caused to come into contact (910).

On the other hand, if, in step S809, it is determined that the amount of time in a state of separation D is shorter, as shown in FIG. 10, the engine control unit 202 maintains the rotation of the photosensitive drum until the time the developing roller is next caused to come into contact (1012).

In steps S813 and S814, similar to steps S509 and S510 in the first embodiment, as shown in FIG. 6, the engine control unit 202 starts causing the developing roller to come into contact.

As described above, the image forming apparatus according to the present embodiment further controls operation of a photosensitive drum when a developing roller has been separated due to the control according to the first embodiment. Specifically, if a developing roller will be in a state of separation for longer than the amount of time necessary for a photosensitive drum to reach a constant-speed rotating state after the rotation thereof has been temporarily stopped and started again, the rotation of the photosensitive drum is also temporarily stopped. Accordingly, it is possible to further reduce the degradation of the photosensitive drum.

Third Embodiment

Next, a third embodiment is described with reference to FIGS. 11A, 11B, and FIG. 12. In the present embodiment, a case is assumed in which both full-color image formation using developing materials of a plurality of colors and monochrome image formation using a developing material of a single color are performed. Furthermore, in the present embodiment, a case of image formation being performed in a throughput priority mode for preferentially performing image formation in a full-color print mode (first mode) in order to maintain throughput is assumed. In the throughput priority mode, in the case in which, when forming images on a plurality of printing materials, the image data after performing image formation in the full-color print mode is monochrome data, image formation is performed in the full-color print mode, without switching to a monochrome print mode (second mode). In the present embodiment, a mechanism is provided for controlling the states of contact and separation of a developing roller, when a postponement time is generated due to an image formation postponement command, in the throughput priority mode. Here, the full-color print mode is a print mode for performing image formation using developing materials of a plurality of colors, and the monochrome print mode is a print mode for performing image formation using a developing material of a single color (black toner).

Note that since the overall configuration and control configuration of the image forming apparatus are similar to those in the first embodiment described with reference to FIG. 1 and FIG. 2, description thereof is omitted. In FIG. 1, the image forming apparatus 10 performs image formation using all the stations in the full-color print mode, and using only the fourth station in the monochrome print mode. Since the communication sequence when printing is similar to that shown in FIG. 4, description thereof is omitted.

Control Procedure Performed by Engine Control Unit

Figure 11A:
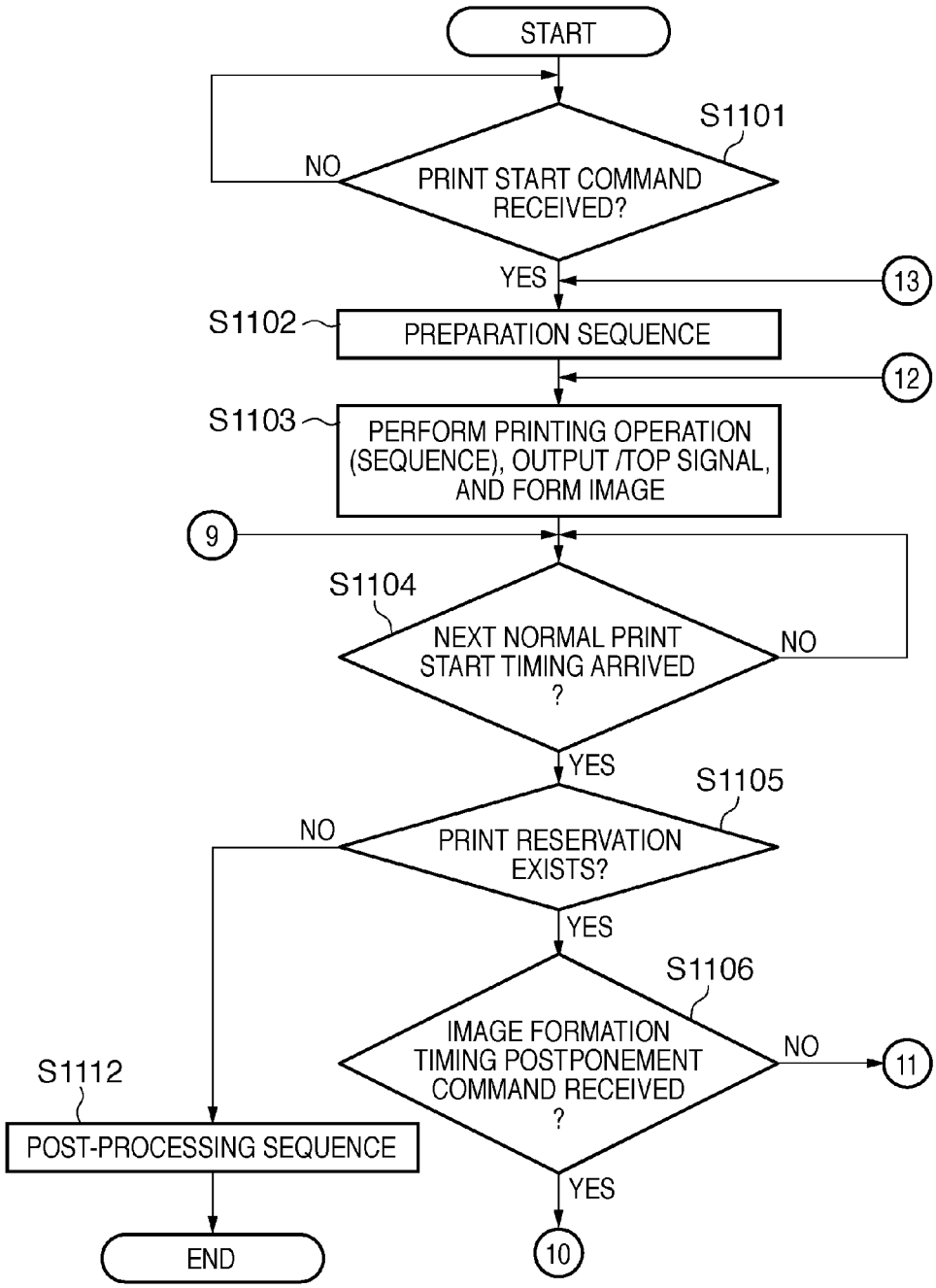
FIGS. 11A and 11B are a flow chart showing a processing procedure performed by an engine control unit in a printing operation according to a third embodiment.
Figure 11B:
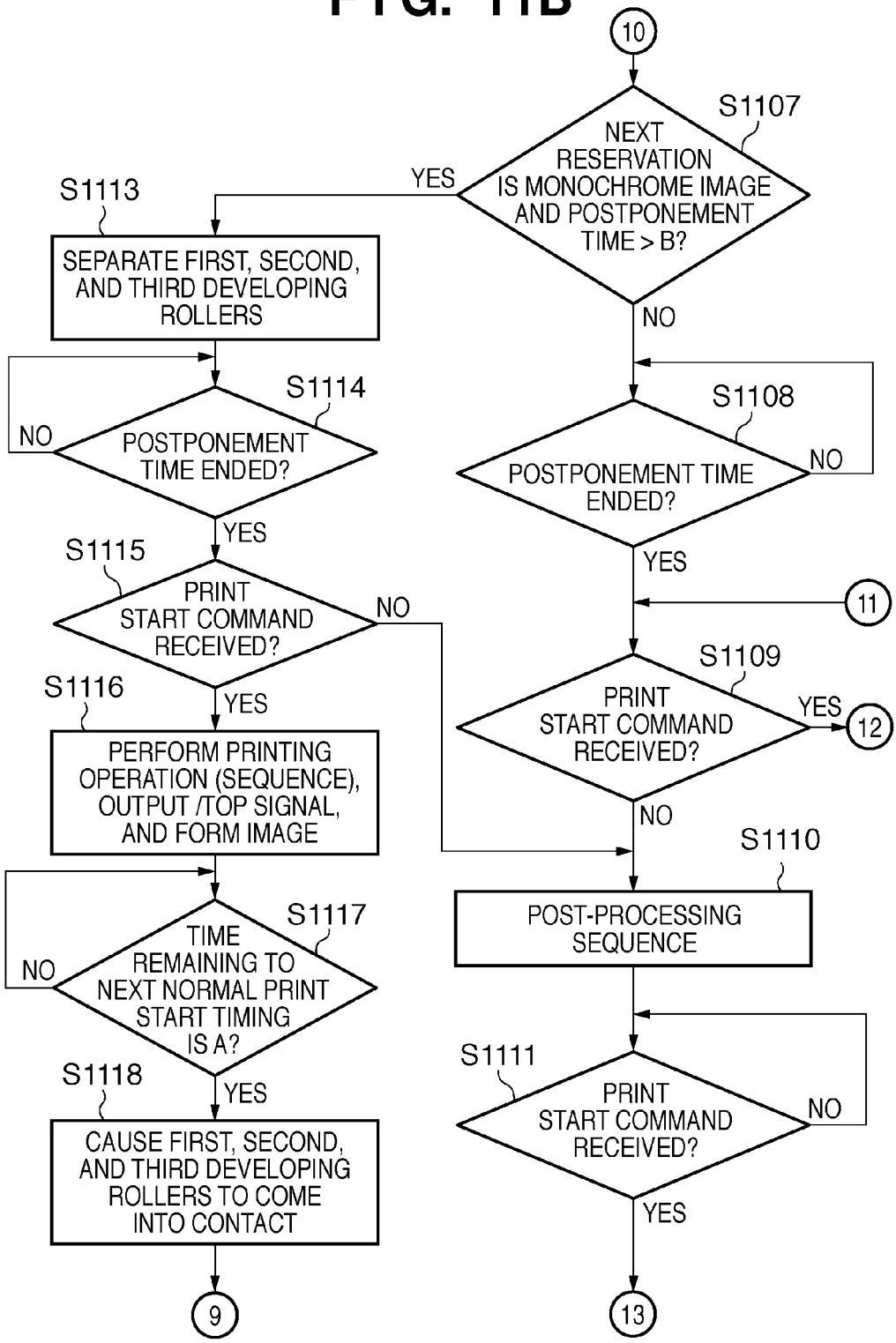

FIGS. 11A and 11B are a flow chart showing a processing procedure performed by the engine control unit 202 in a printing operation according to the third embodiment. FIG. 12 is a timing chart showing the timing of a printing operation performed by the engine control unit 202 according to the third embodiment. FIGS. 11A, 11B and FIG. 12 show a case of continuously printing three sheets of printing material, and a case in which full color image data is printed on the first and third sheets, and monochrome image data is printed on the second sheet. In FIG. 12, reference numeral 1201 denotes the output timing of /TOP signals, reference numeral 1202 denotes the operation timing of the developing rollers of the first, second, and third stations, and reference numeral 1203 denotes the operation timing of the developing roller of the fourth station. Signals 1205, 1206, 1207, and 1208 on reference numeral 1201 are /TOP signals. Printing (forming) an image for the first sheet is started by the signal 1205, and next, the signal 1206 indicates the normal print start timing for printing (forming) an image for the second sheet. In FIG. 12, a postponement time C is designated, and the timing for printing the image for the second sheet is delayed until the signal 1207. Note that although the signal 1208 indicates the normal print start timing for printing an image for the third sheet, the printing operation ends at the printing of images for two sheets in the case of FIG. 12.

First, the controller 201 transmits a print reservation command to the engine control unit 202. In response to this, in step S1101, the engine control unit 202 stands by until receiving a print start command subsequently issued from the controller 201.

In step S1102, the engine control unit 202 executes a preparation sequence in the full-color print mode (first mode), based on the print start command received in step S1101. In the preparation sequence in the full-color print mode, the engine control unit 202 causes the developing rollers to come into contact with the photosensitive drums in all the stations.

In step S1103, the engine control unit 202 outputs a /TOP signal after a preparation sequence has ended, and starts a print operation according to the conditions designated by the print reservation command for the first sheet. Here, a print reservation command includes print operation conditions such as information regarding the paper feed cassette to be used, the printing material size, and the operational mode.

If, in step S1105, the next print reservation command has not been received by the normal print start timing, the engine control unit 202 proceeds to step S1112, and executes a post-processing sequence, before ending the print operation.

If, in step S1106, an image formation timing postponement command to which the postponement time C has been added is received by the normal print start timing, the engine control unit 202 proceeds to step S1107. On the other hand, if the postponement command is not received, the engine control unit 202 proceeds to step S1109.

In step S1107, the engine control unit 202 firstly determines the type of image data relating to the next print reservation. Determining the image data type involves determining whether the image data is color image data that has a plurality of colors or monochrome image data that has only a single color (black). Furthermore, the engine control unit 202 determines whether or not the designated postponement time C is longer than the amount of time B (1209) shown in FIG. 12 necessary for separating the developing roller. If the determination result indicates that the next print reservation is for monochrome image data and the postponement time C is longer than the amount of time B, the monochrome print mode (second mode) is decided on, and the processing proceeds to step S1113. In contrast, if the next print reservation is for full color image data or the postponement time C is shorter than time B, the full-color print mode is decided on, and the processing proceeds to step S1118.

Processing in Monochrome Print Mode

The engine control unit 202 executes the following processing, if the monochrome print mode is decided on in step S1107.

Figure 12:
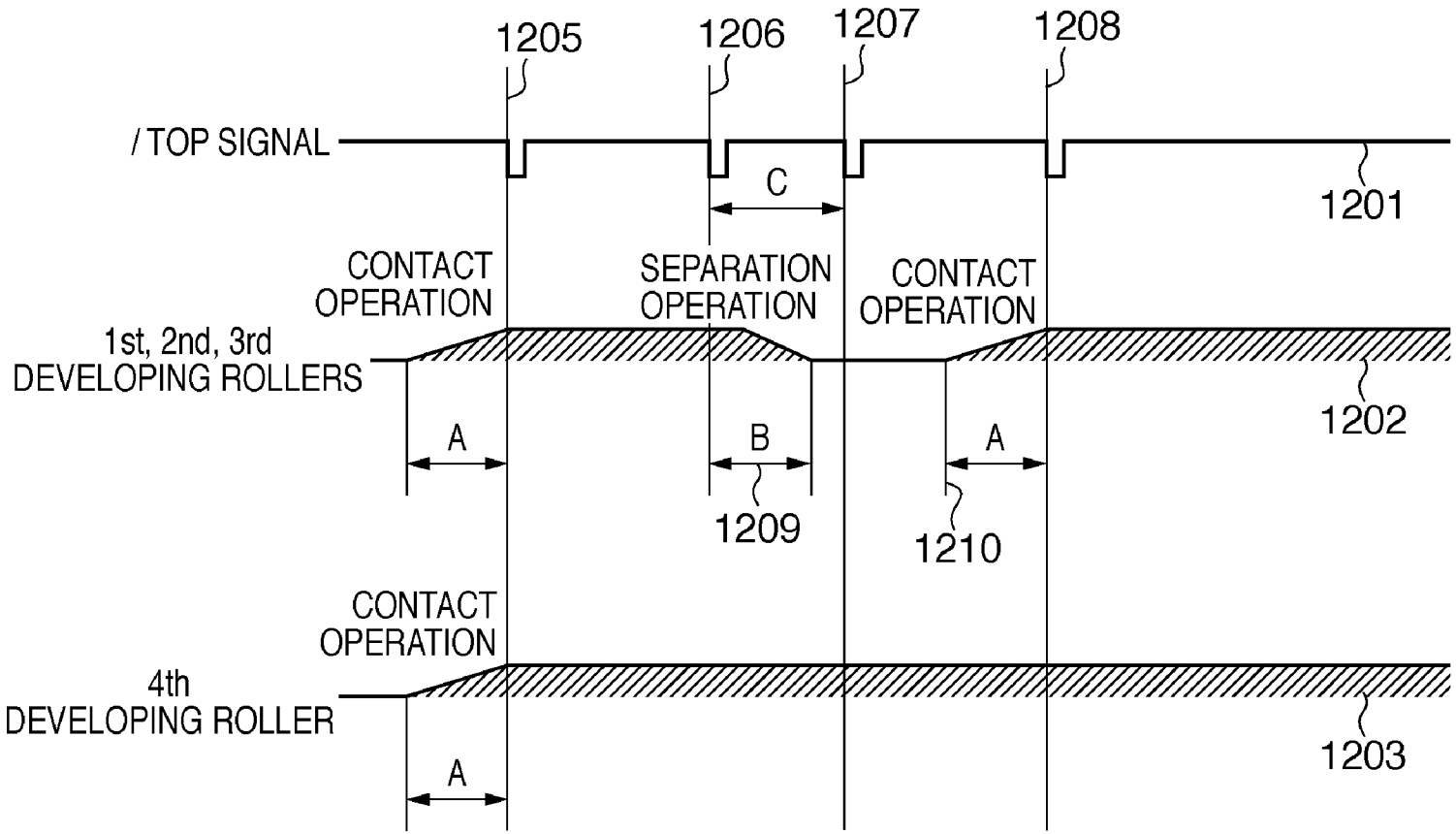
FIG. 12 is a timing chart showing the timing of a printing operation performed by the engine control unit according to the third embodiment.

In step S1113, as shown in FIG. 12, the engine control unit 202 causes the developing rollers of the first, second, and third stations that are not needed for printing monochrome image data to separate, and maintains a state of contact of only the developing roller of the fourth station.

Furthermore, in steps S1114 and S1115, the engine control unit 202 maintains the developing rollers in the state controlled in step S1113 until the designated postponement time C elapses. If a print start command is not received during this time, the processing proceeds to step S1110, and the engine control unit 202 executes a post-processing sequence, and stands by until receiving a print start command from the controller in step S1111. On the other hand, if a print start command is received, the processing proceeds to step S1116.

In step S1116, the engine control unit 202 starts a print operation for the second sheet in the monochrome print mode.

In steps S1117 and S1118, as shown in FIG. 12, so that the developing rollers of the first, second, and third stations are completely in contact at the print start timing for the third sheet for maintaining optimal throughput (1208), the engine control unit 202 starts causing the developing rollers to come into contact at the timing at which the amount of time A remains to that timing (1210), and processing proceeds to step S1104.

Processing in Full-Color Print Mode

On the other hand, if the full-color print mode is decided on in step S1107, the engine control unit 202, in step S1108, maintains a state of contact with the developing rollers during the designated postponement time C.

If, in step S1109, a print start command for the print reservation command is received before the normal print start timing, in a case in which an image formation postponement command has not been received, the engine control unit 202 proceeds to step S1103. If, in a case in which an image formation postponement command has been received, a print start command for a print reservation command is received by the time that the designated postponement time elapses, the engine control unit 202 proceeds to step S1103. In step S1103, the engine control unit 202 starts a printing operation for the second sheet following the first sheet.

On the other hand, if, in step S1109, the engine control unit 202 has not received a print start command, the processing proceeds to step S1110.

In step S1110, the engine control unit 202 executes a post-processing sequence, and, in step S1111, stands by until receiving a print start command from the controller 201.

As described above, in the throughput priority mode, the image forming apparatus according to the present embodiment executes processing for switching to the monochrome print mode if image formation is postponed. Specifically, if there is sufficient time to separate the developing roller from the photosensitive drum, the photosensitive drum and the developing roller are separated. Accordingly, it is possible to reduce the degradation due to wear of the photosensitive drum and the developing roller.

Furthermore, it is also possible to combine the present embodiment and the second embodiment. As a result, when continuously printing full color images, it is also possible to further reduce the degradation of a photosensitive drum and a developing roller, in the case in which the time when a developing roller can come into contact and be separated is postponed due to an image formation timing postponement command.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-292608, filed Nov. 14, 2008, and No. 2009-247620, filed Oct. 28, 2009, which is hereby incorporated by reference herein in their entirety.

What is claimed is:

1. An image forming apparatus comprising:

an image carrier for having an image formed thereon;

a developing member that is capable of coming into contact with and separating from the image carrier, and that forms an image on the image carrier by coming into contact with the image carrier and is separated from the image carrier after image formation on the image carrier ends; and a determination unit that determines, in a case in which a start of image formation is delayed beyond a predetermined start timing of image formation on the image carrier, when continuously forming a plurality of images, whether to separate the developing member from the image carrier, based on a delay time until the start of image formation and a time necessary for the developing member to separate from and come into contact with the image carrier.

2. The image forming apparatus according to claim 1, wherein the determination unit separates the developing member from the image carrier, when the delay time is longer than the time necessary for the developing member to separate from and come into contact with the image carrier, and maintains a state of contact without separating the developing member from the image carrier, when the delay time is shorter than the time necessary for the developing member to separate from and come into contact with the image carrier.

3. The image forming apparatus according to claim 2, wherein the determination unit further stops driving of the image carrier when the delay time is longer than a time obtained by adding the time necessary for the developing member to separate from and come into contact with the image carrier and a time necessary for stopping and starting driving of the image carrier.

4. The image forming apparatus according to claim 3, wherein the determination unit stops driving of the image carrier for a duration of a time difference obtained by subtracting the added time from the delay time.

5. The image forming apparatus according to claim 2, wherein the determination unit further separates the developing member from the image carrier for a duration of a time difference obtained by subtracting the time necessary for the developing member to separate from and come into contact with the image carrier from the delay time.

6. The image forming apparatus according to claim 1, further comprising an intermediate transfer member for having the image formed on the image carrier transferred thereonto, wherein the predetermined start timing of image formation is set according to a timing at which the image formed on the image carrier will be transferred onto the intermediate transfer member.

7. The image forming apparatus according to claim 1, further comprising an intermediate transfer member for having multiple transfer of the plurality of images formed on the plurality of image carriers performed thereon, wherein the predetermined start timing of image formation is set according to a timing at which multiple transfer of the plurality of images formed on the plurality of image carriers onto the intermediate transfer member will be performed.

8. An image forming apparatus that is provided with a plurality of image forming units each including an image carrier for having an image formed thereon, and a developing member which is capable of coming into contact with and separating from the image carrier, and which forms an image on the image carrier by coming into contact with the image carrier and is separated from the image carrier after image formation on the image carrier ends, and that is capable of switching between a first mode in which a multicolor image is formed using all of the plurality of image forming units, and a second mode in which a single color image is formed using one of the plurality of image forming units, the image forming apparatus comprising:

a control unit that performs control such that an image is formed in the first mode, in a case in which there are both the multicolor image and the single color image, when continuously forming a plurality of images; and a determination unit that determines, in a case in which a start of formation of the single color image is delayed beyond a predetermined start timing of image formation in a case of forming the single color image after formation of the multicolor image, whether to separate the developing member of the image forming unit other than the image forming unit to be used for forming the single color image, based on a delay time until the start of formation of the single color image and a time necessary for the developing member of the image forming unit other than the image forming unit to be used for forming the single color image to separate and come into contact.

9. The image forming apparatus according to claim 8, wherein the determination unit separates the developing member from the image carrier for a duration of a time difference obtained by subtracting the time necessary for the developing member to separate and come into contact from the delay time.

10. The image forming apparatus according to claim 8, wherein the plurality of image forming units each forms an image using a yellow, magenta, cyan, or black developing material, and the single color image is formed using the black developing material.

11. A method for controlling an image forming apparatus that is provided with an image carrier for having an image formed thereon, and a developing member which is capable of coming into contact with and separating from the image carrier, and which forms an image on the image carrier by coming into contact with the image carrier and is separated from the image carrier after image formation on the image carrier ends, the method comprising the steps of:

comparing a delay time for a case in which a start of image formation is delayed relative to a predetermined start timing of image formation on the image carrier with a time necessary for causing the developing member to come into contact with and separate from the image carrier, when continuously forming a plurality of images; and determining whether to separate the developing member from the image carrier, based on a comparison result.

12. The method for controlling the image forming apparatus according to claim 11, the method further comprising the step of separating the developing member when the comparison result indicates that the delay time is longer than the time necessary for causing the developing member to come into contact with and separate from the image carrier.

* * * * *